US011319102B2

(12) United States Patent
Brandt

(10) Patent No.: US 11,319,102 B2
(45) Date of Patent: May 3, 2022

(54) PROCESSING APPARATUS FOR PACKAGING MACHINES

(71) Applicant: Weber Maschinenbau GmbH Breidenbach, Breidenbach (DE)

(72) Inventor: Michael Brandt, Eschenburg (DE)

(73) Assignee: Weber Maschinenbau GmbH Breidenbach

( * ) Notice: Subject to any disclaimer, the term of this patent is extended or adjusted under 35 U.S.C. 154(b) by 132 days.

(21) Appl. No.: 16/455,000

(22) Filed: Jun. 27, 2019

(65) Prior Publication Data

US 2020/0010228 A1 Jan. 9, 2020

(30) Foreign Application Priority Data

Jul. 6, 2018 (DE) ..... 102018116389.4

(51) Int. Cl.
*B65B 61/02* (2006.01)

(52) U.S. Cl.
CPC ..... *B65B 61/025* (2013.01); *B65B 61/02* (2013.01)

(58) Field of Classification Search
CPC ..... B65B 61/02; B65B 61/025
USPC ..... 53/411
See application file for complete search history.

(56) References Cited

U.S. PATENT DOCUMENTS 3,662,511 A * 5/1972 Eliasberg ..... B65B 7/164 53/411
2007/0220827 A1* 9/2007 Conti ..... B65B 9/045 53/111 R
2021/0039409 A1* 2/2021 Costal Fornells ..... B41J 2/2117

FOREIGN PATENT DOCUMENTS

| | | | | |
|---|---|---|---|---|
| DE | 102006047488 | A1 | 4/2008 | |
| DE | 102008007890 | A1 | 8/2009 | |
| EP | 1790470 | A2 | 11/2006 | |
| EP | 1790470 | A2 * | 5/2007 | ..... B65B 61/025 |
| EP | 2974972 | A1 | 1/2016 | |
| EP | 3266721 | A1 | 1/2018 | |
| WO | 2010109426 | A1 | 9/2010 | |

OTHER PUBLICATIONS

Espacenet machine translation of EP 1790470 A2 (Year: 2007).*
Communication received from the German Patent and Trademark Office for related German Patent Application No. 19172470.7; dated Aug. 5, 2019; 3 pages.
Communication received from the European Patent and Trademark Office for related European Patent Application No. 102018116389.4; dated Mar. 20, 2019; 2 pages.

* cited by examiner

*Primary Examiner* — Anna K Kinsaul
*Assistant Examiner* — Himchan Song
(74) *Attorney, Agent, or Firm* — Dickinson Wright PLLC

(57) ABSTRACT

The invention relates to a processing apparatus for packaging machines having at least one upper processing unit for processing upper package sides and at least one lower processing unit for processing lower package sides, and having a common adjustment axle for the processing units along which the processing units are adjustable manually or by means of a drive in an adjustment direction that extends in parallel with a direction of transport of the packaging machine.

17 Claims, 3 Drawing Sheets

PROCESSING APPARATUS FOR PACKAGING MACHINES

Figure 1:
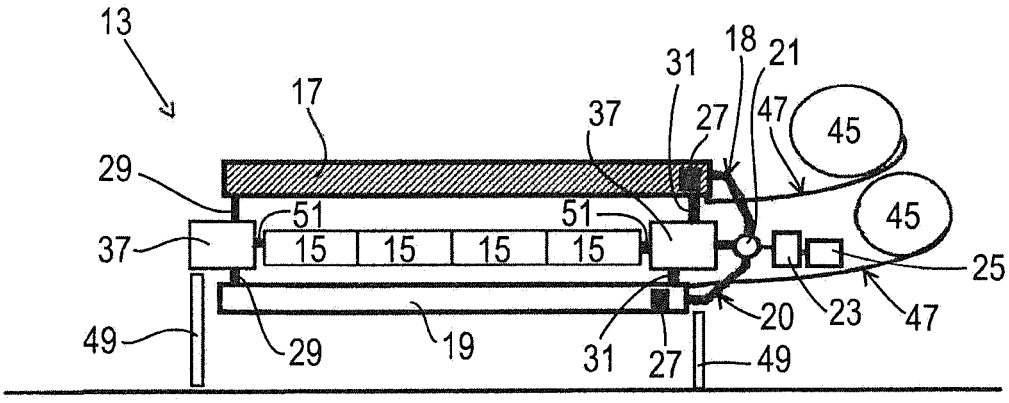

The invention relates to a processing apparatus for packaging machines, in particular for labeling and/or printing packages, having at least one upper processing unit for processing upper package sides and having at least one lower processing unit for processing lower package sides. The invention also relates to a packaging machine, in particular for food products, having at least one processing apparatus in accordance with the invention.

Packaging machines such as are in particular used for packaging food products typically comprise a plurality of work stations that are consecutively arranged long a direction of work or transport. The products are frequently not only packaged in such food processing lines using packaging machines, but the packages are rather only produced in the first place. In so-called deep-drawing packaging machines that are very frequently used for packaging food products, the packages are produced from at least two material webs, in particular film webs, namely a so-called lower film and a so-called upper film. A shaping of the lower film by means of a deep-drawing process is typically carried out at a deep-drawing station disposed in the starting region of the packaging machine to, for example, produce a tray-like lower part of a respective package. The products are placed into the lower package parts at an adjoining placement station. The upper film is subsequently supplied that is placed onto the lower package parts filled with the products, that is onto the lower film, whereupon the two films are sealed in a sealing station of a packaging machine to close the packages. At least the film web forming the lower film is respectively gripped by conveying chains of the packaging machine provided with holding clamps after the unwinding from a supply roll during this process and is transported through the individual work stations along the packaging machine.

The work procedure in such a deep-drawing packaging machine in particular takes place in a clocked manner. In each work cycle, a predefined film length is pulled off and transported along the packaging machine, wherein a work cycle corresponds to at least one package or—if the packaging machine is configured with multiple tracks—to at least one package row disposed transversely to the direction of transport.

It is frequently necessary in practice to carry out further processing procedures at the packages or at the material webs or film webs. It is in particular necessary in multiple cases to provide the packages with information for the further processing, for the transport, for the retail trade, and above all for the end consumer of the packaged products. The packages are provided with labels and/or printed for this purpose. This frequently takes place in practice at the packaging machines themselves that are provided with corresponding processing apparatus for this purpose. They are typically arranged at an end region of the packaging machine to label or print the completed packages still contiguous as a film web, for example. It is, however, possible in this respect to provide the respective material webs with labels or to print them at a different position of the packaging machine.

Processing apparatus such as labelers and printers for packages have been known for a long time. It is also known in this respect to support such processing apparatus directly at the packaging machine, in particular at a machine frame extending in the direction of transport and to configure it as travelable in the direction of transport manually or by means of a drive to be able to set the respective processing position relative to the respective package or package row. To keep the effort within limits and to keep the space requirements or the work length of the packaging machine as small as possible, only a single machining apparatus is frequently provided in practice that can process either only the upper package sides or only the lower package sides.

It is, however, generally also known to provide two separate, independent machining apparatus of which the one can process the upper package sides and other can process the lower package sides. The large space requirements of the structures is problematic with processing apparatus for packaging machines, in particular with labelers. Labelers, for example, inter alia require a label supply and a label feed. This structure typically projects laterally and upwardly above the actual boundary of the packaging machine. If two separate labeling apparatus are to be used, they are in practice offset with respect to one another in the direction of transport and are additionally arranged such that the structure of the one labeler is disposed on the one side of the packaging machine and the structure of the other labeler is disposed on the opposite machine side. This facilitates the arrangement of two labelers, but has the disadvantage that the operator constantly has to switch between the two machine sides to, for example, change the label supply rolls, to thread the supply rolls into the label feed, to carry out finer settings, or to take care of other procedures required during the ongoing operation of the packaging machine. This is above all also problematic because packaging machines have an enormous length today and the operator consequently has to cover long distances in a brief time.

The putting into operation and setting of processing machines at packaging machines, in particular of labelers and printers, are consequently frequently associated with a laborious and difficult operation in practice. This problem becomes constantly greater due to the ever increasing degree of automation and to the associated greater length of packaging machines.

It is therefore the object of the invention to provide a possibility of processing packages at packaging machines that has space requirements that are as small as possible and that permits an operation that is as simple as possible.

This object is satisfied by a processing apparatus for packaging machines, in particular for labeling and/or printing packages, having at least one upper processing unit for processing upper package sides and at least one lower processing unit for processing lower package sides; and having a common adjustment axle for the processing units along which the processing units are adjustable manually or by means of a drive in an adjustment direction that extends in parallel with a direction of transport of the packaging machine.

In accordance with the invention, a common adjustment axle is thus provided for the processing units along which the processing units are adjustable manually or by means of a drive in an adjustment direction that extends in parallel with a direction of transport of the packaging machine. The object is additionally satisfied by a packaging machine having at least one processing apparatus in accordance with the invention.

Only one common adjustment axle is provided in accordance with the invention for the processing machines. The invention thus departs from the path previously taken in the prior art of, in the event of a plurality of processing units, considering and accordingly configuring and operating them as separate, independent machines that each require a complete, separate infrastructure to be able to be attached to the packaging machine and in particular to be able to be adjusted in the direction of transport of the packaging machine.

The common adjustment axle is to be understood as a concrete component or assembly that enables an adjustment of the processing units that takes place manually or by means of a drive in parallel with the direction of transport of the packaging machine. In the case of a manual adjustability, the adjustment axle can be a component or assembly, for example a guide rod, with this component or assembly consequently also being able to satisfy a guidance function, that is specifically designed in any manner and that extends over a suitable adjustment length in parallel with the direction of transport of the packaging machine. Additional guides for the processing units are, however, not hereby precluded.

If a drive is provided for the adjustment of the processing units, the adjustment axle can then form or comprise a common drive member for the processing units or can be formed by such a drive member. This drive member can, for example, be a spindle, a toothed belt, or a gear rack.

The concept of the invention makes it possible to transpose the operation of all the processing units completely to only one of the sides of the packaging machine. At the other machine side, for example, an additional guide for the processing units can be provided that the operator, however, does not have to consider at least during the ongoing operation of the packaging machine.

A further advantage of a common adjustment axle for a plurality of processing units comprises specific safety engineering measures—where they are required in principle—only having to be taken at one side of the packaging machine. For example, when the processing units are adjustable in opposite senses with respect to the direction of transport of the packaging machine in accordance with a preferred embodiment, a risk of injury potentially present for the operator due to this adjustability may have to be avoided by suitable measures such as the provision of a cover on the basis of applicable safety regulations.

In addition, with a common adjustment axle for the processing units, its integration is facilitated, in particular in a safety engineering aspect, or is even only made possible at all. Settings of the processing units can, for example, take place via the central control of the packaging machine or of the total processing line into which the packaging machine is optionally integrated.

The concept in accordance with the invention furthermore makes a variety of work variants possible which will be looked at in more detail in another passage, with at least specific variants previously not having been able to be implemented or at best while accepting a considerable additional requirement of work length of the packaging machine.

It is possible, but not necessary, that only a single common adjustment axle is provided for the processing units. At least one further common adjustment axle can be provided, with then all the common adjustment axles of the processing machines being arranged at the same side of the packaging machine. An adjustment axle, that can also be called a main adjustment axle, can here primarily be provided for a common adjustment of the processing units. A processing unit decoupled from the main adjustment axle can be coupled to a further common adjustment axle and can, for example, be moved into a non-working position along this further common adjustment axle independently of the processing unit or of the other processing units.

A common adjustment axle in the sense of the invention can also be provided such that the one processing unit does not cooperate directly with the common adjustment axle, but only indirectly via the respective other processing unit that directly cooperates with the common adjustment axle. The two processing units are in this respect consequently not adjustable independently of one another by means of the common adjustment axle. However, this does not preclude the processing units from being movable relative to one another to, for example, be able to change an offset between the two processing units in the direction of transport of the packaging machine.

Preferred embodiments can also be seen from the following description, from the independent claims, and from the drawing.

In accordance with a preferred embodiment, a common travel drive for the two processing units is provided by which the processing units can be traveled along the adjustment axle.

The travel drive can be an elongated drive member extending in the direction of adjustment for the processing units. The drive member can, for example, be a spindle, a toothed belt, or a gear rack.

Provision can further be made that the processing units are couplable to the adjustment axle and are decouplable from the adjustment axle independently of one another. This makes possible an extremely flexible operation of the packaging machine with respect to the function of the processing units. If the processing units are all coupled to the adjustment axle, the processing units can be adjusted together. The processing units can, for example, change their positions along the packaging machine together, with an optionally present offset between the two processing units in the direction of transport being able to remain constant. An offset between the processing units does not, however, have to be present and—if it is present—does not have to be constant. Alternatively, a common adjustment of respective processing units coupled to the adjustment axle can also be accompanied by an increasing or decreasing distance between the processing units in the direction of transport.

It is furthermore possible to decouple a processing unit from the adjustment axle, for example. The decoupled processing unit can be moved—manually or via a drive optionally additionally provided—into a non-working position at the packaging machine, for example for servicing purposes or for applying a new label supply roll, while the or each other processing unit continues its processing operation.

Provision can furthermore be made in accordance with the invention that each processing unit comprises a manually actuable coupling device or a coupling device controllable by means of a control device, said coupling device being configured to couple and decouple the processing unit and the adjustment axle to one another and from one another. The control device can be associated with the processing apparatus and can in particular be integrated in the processing apparatus and can be connected in a suitable manner to a central control device of the packaging machine. Alternatively, the control device serving for the control of the coupling devices of the processing unit can be integrated in a central control device of the packaging machine or of a higher ranking processing line.

In accordance with a further embodiment, a guide extending in parallel with the direction of adjustment is provided for the processing apparatus in addition to the common adjustment axle. The guide can be a guide member or can comprise at least two guide members extending transversely to the direction of adjustment at a spacing from one another. The guide members can, for example, be simple, passive guide rods. If two spaced apart guide members are provided, they can be arranged at oppositely disposed sides of the packaging machine. A particularly stable and precise guidance and alignment of the processing units with respect to the respective packaging machine hereby result. While the or each common adjustment axle for the processing units is only arranged at one machine side, guide devices for the processing units can thus be present at both sides of the packaging machine.

In accordance with a further possible embodiment, at least one transverse axle extending transversely to the direction of transport for at least one additional unit is provided in addition to the adjustment axle for the processing units. The transverse axle can be movable along the adjustment axle in the direction of adjustment manually or by means of a drive. The additional unit for which the additional transverse axle is provided can, for example, be a printing device for printing the upper package sides or the lower package sides, for example.

As already mentioned above, in accordance with a preferred embodiment of the invention, the processing units are each a labeling unit, with the upper labeling unit serving for the labeling of upper package sides and the lower labeling unit serving for the labeling of lower package sides. Alternatively, the processing units can each be designed as printing units for printing the package sides. Furthermore, "mixed" applications are also possible in accordance with the invention in which different processing units are used. For instance, the upper package sides can, for example, be labeled by means of an upper labeling unit and the lower package sides can be printed by means of a lower printing unit.

With a packaging machine in accordance with the invention, in particular with a machine for packaging food products, that comprises at least one processing apparatus in accordance with the invention as disclosed herein, provision can be made in accordance with a preferred embodiment that the processing apparatus is supported at a machine frame of the packaging machine. This does not preclude an additional support, that is, however, not sufficient alone, taking place via another device not formed by the packaging machine or not belonging to the packaging machine or via a placement surface, in particular the floor. The processing apparatus is preferably only supported at the packaging machine and in particular at a rack or frame of the packaging machine.

The adjustment axle of the packaging machine is preferably arranged at a side of a machine frame or of a machine rack of the packaging machine. The adjustment axle is preferably supported at the machine frame or at the machine rack. The support of the adjustment axle in particular only takes place in this manner.

The processing units of the processing apparatus can be arranged, viewed in the direction of transport, in the same work section of the packaging machine that is associated with a package or with a package row disposed transversely to the direction of transport. In this configuration, the same respective package is consequently processed by the processing units, i.e. the upper package side is respectively processed by the upper processing unit and the lower package side respectively by the lower processing unit. If it is a multi-track packaging machine, the processing units each process the same package row. An offset between the processing units can be provided in the direction of transport of the packaging machine within the work section. This offset can result from the respective desired processing positions that can differ for the upper package side and the lower package side of a respective package. It can, for example, be desired to apply a label for the upper package side to a region of the package at the front in the direction of transport, whereas a label or a print at the lower package side should be attached in the rear package region viewed in the direction of transport.

In accordance with a further embodiment, an alternative configuration can be provided in which the processing units are arranged in different work sections that are offset from one another in the direction of transport and that are each associated with a package or with a package row disposed transversely to the direction of transport. The work sections can be offset from one another in the direction of transport by one or more packages or package rows or can—in other words—be spaced apart from one another. This configuration can, for example, be of advantage in dependence on the specific embodiment and on an optionally present structure of the processing units projecting beyond the boundary of the actual packaging machine. In addition, the operation of the processing units can hereby optionally be facilitated.

In accordance with a further embodiment of the invention, a plurality of pairs comprising a respective upper processing unit and a lower processing unit can be provided that are arranged in different work sections offset from one another in the direction of transport, with each work section being associated with a package or with a package row disposed transversely to the direction of transport.

The performance of the packaging machine can hereby be multiplied with respect to the processing of the packages by means of the processing units in accordance with the number of pairs. The processing performance can thus, for example, be doubled using two pairs of processing units. A further possibility that results from the use of a plurality of pairs of processing units comprises carrying out additional processing steps at the packages, for example applying one or more additional labels that are optionally only desired at times.

Provision can furthermore be made that the processing units or pairs of processing units are movable independently of one another from a working region into a non-working position. A pair of processing units can thus, for example, be serviced in the non-working position or can, for example, be provided with a new label supply without a standstill of the packaging machine, nevertheless with a temporary reduction of the processing power. Subsequent to this interruption, the temporarily non-active pair of processing units can again be traveled back into the respective work section, whereupon the original full performance is again available.

Independently of the respective specific configuration of the packaging machine in accordance with the invention, provision can be made that the processing units are each movable in the direction of adjustment within their work sections to set a respective desired working offset between an upper processing position and a lower processing position.

A control device is furthermore preferably provided that is configured to control a travel drive of the processing apparatus and to control the processing units, in particular coupling devices of the processing apparatus, in dependence on the respective operating situation to adjust the processing units together or individually in the direction of adjustment.

The coupling units can, as already mentioned above, serve to couple and decouple the respective processing unit and the adjustment axle to one another and from one another. This can take place independently of one another for the processing units. As likewise already mentioned above, the control device can be associated with the processing unit or can be integrated into a central control device of the packaging machine.

The invention will be described in the following by way of example with reference to the drawing. There are shown:

FIG. 1 schematically in a view sectioned perpendicular to the direction of transport of the packaging machine, the arrangement of two processing units in accordance with the invention; and FIGS. 2 to 5 respectively schematically, a possible configuration of a packaging machine in accordance with the invention.

The packaging machine 13 shown schematically in cross-section in FIG. 1 comprises a machine frame 37 that is supported on the floor via a lower rack 49. A left transport chain 51 and a right transport chain 51 are supported at the respective frame element of the machine frame 37 extending in the direction of transport via chain guides, not shown, and serve, as described in the introductory part, to transport a lower film through the packaging machine 13 to manufacture packages 15 having food products received therein (not shown) from it together with an upper film. In the example shown, the packaging machine 13 is formed with four tracks, i.e. four packages 15 that are separated toward the end of the work process are disposed next to one another in each package row 41 (cf. FIGS. 2 to 5).

The generally known structure and the function of a packaging machine, and in particular of a deep-drawing packaging machine such as has been explained in the introductory part, likewise sufficiently familiar to the skilled person do not need to be looked at in any more detail with respect to the present invention.

The packaging machine 13 in accordance with the invention is provided with a processing apparatus 11 that serves to process the upper sides and the lower sides of the packages 15. For this purpose, the processing apparatus 11 comprises at least one pair of processing units, namely an upper processing unit 17 that is located above the packages 15 and a lower processing unit 19 below the packages 15.

The processing in the present embodiment is the application of labels. A respective structure that inter alia comprises a label supply roll 45 and a feed for the label web 47 rolled up in the supply 45 is associated with both processing units 17, 19 respectively formed as labelers. As can be seen from FIG. 1, these structures of the processing units 17, 19 project laterally and upwardly beyond the machine frame 37 of the packaging machine 13.

These structures comprising the supply roll 45 and the label feed, not shown in any more detail, are each connected to the respective processing unit 17, 19 such that they are always moved together with their respective processing units 17, 19 on an adjustment movement of the respective processing unit 17, 19 in the direction of transport T of the packaging machine 13 and against the direction of transport T—that is in the adjustment direction S (cf. FIGS. 2 to 5).

The adjustment movements of the processing units 17, 19 are guided at the machine frame 37 in the embodiment shown here. For this purpose, respective guides 29, 31 are provided at the left side and at the right side of the machine frame 37 and are only indicated schematically in FIG. 1 and in each case as chain-dotted lines in FIGS. 2 to 5.

The guides 29, 31 can comprise only passive guide members such as guide rods that are supported by the machine frame 37 and do not have any drive function for the respective processing unit 17, 19.

The provision of a guide for the processing apparatus 11 is, however, not compulsory in accordance with the invention. Depending on the specific embodiment of the processing apparatus 11 and the common adjustment axle 21 described in more detail below for the processing units 17, 19, the adjustment axle 21 can be sufficient to ensure the required stability and guidance and to enable an adjustment of the processing units 17, 19 in the direction of adjustment S.

The position of the adjustment axle 21 shown in FIG. 1 relative to the packaging machine 13 is to be understood purely schematically. The adjustment axle 21 can be arranged at generally any desired point at one of the machine sides in dependence on the specific structure of the packaging machine 13 and in particular of the machine frame 37. In the embodiments shown here, the adjustment axle 21 is located at the right machine side—viewed in the direction of transport T. The adjustment axle 21 is indicated in FIGS. 2 to 5 by a dashed line thicker in comparison with the guides 29, 31.

As FIG. 1 shows, the upper processing unit 17 and the lower processing unit 19 are each connected to the common adjustment axle 21. This takes place in each case by an only schematically indicated holder 18, 20.

To be able to adjust the processing units 17, 19 by means of the adjustment axle 21, the adjustment axle 21 can, for example, be configured as a threaded spindle which extends in parallel with the direction of transport T and to which spindle nuts formed at the holders 18, 20 can be coupled. The threaded spindle acting as an adjustment axle 21 can e.g. be manually actuated. In a preferred embodiment, however, a drive 23 is provided for the adjustment axle 21, said drive being shown schematically in FIG. 1, being connected to a control device 25, and thus enabling a controlled adjustment of the processing units 17, 19 in that the threaded spindle forming the adjustment axle 21 is correspondingly set into rotation. As likewise already mentioned in the introductory part, the control device 25 can only be associated with the processing apparatus 11 and can be connected to a higher ranking control device, not shown, of the packaging machine 13. Alternatively, the control device 25 can be integrated in such a central control device.

Instead of a spindle drive for the processing units 17, 19, a differently configured travel drive can also be provided that is, for example, based on the drive principle of a toothed belt or of a gear rack.

As FIG. 1 likewise schematically shows, each of the two processing units 17, 19 is provided with a coupling device 27 that permits the respective processing unit 17, 19 to be selectively drive-effectively coupled to the adjustment axle 21 or decoupled from the adjustment axle 21 via its holder 18, 20. An individual, mutually independent adjustment movement of the two processing units 17, 19 is possible in this manner.

FIGS. 2 to 5 show by way of example different configurations in which the processing units 17, 19 of the processing apparatus 11 can be positioned and adjusted relative to one another at the packaging machine 13 with respect to the direction of transport T and in particular with respect to the packages 15 or package rows 41.

Figure 2:
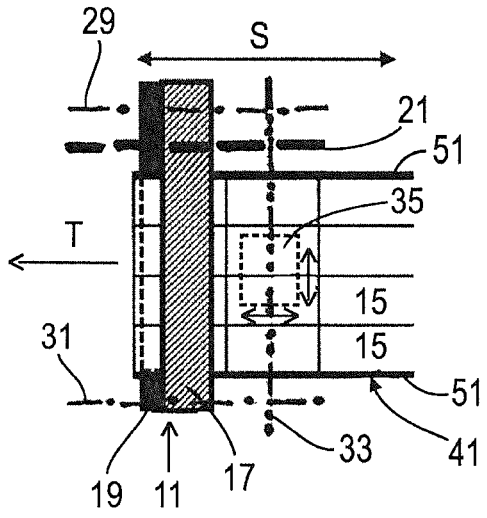

Only FIG. 2 shows an additional option that can, however, generally equally be used in all the possible configurations in accordance with the invention, namely the provision of an additional unit 35 which can, for example, be a printing device for printing either the upper package sides or the lower package sides. A transverse axle 33 is provided for this additional unit 35 and extends perpendicular to the direction of transport T and—also like the processing units 17, 19—can be moved in the adjustment direction S by means of the common adjustment axle 21 to be able to adopt the printing position on the upper package sides or on the lower package sides with respect to a package row 41. The additional unit 35 is additionally adjustable along the transverse axle 33 to be able to respectively reach all the packages 15 of a package row 41. The thus given movement possibilities of the additional unit 35 are indicated by the double arrows in FIG. 2.

In the embodiment of FIG. 2, the upper processing unit 17 and the lower processing unit 19 are associated with the same package row 41 and thus—viewed in the direction of transport T—with the same work section. The two processing units 17, 19 are substantially disposed above one another in this respect. The offset between the two processing units 17, 19 present within this same work section in the adjustment direction S is settable by moving the processing units 17, 19 along the adjustment axle 21. The processing position with respect to the packages 15 of the respective package row 41 can hereby be exactly predefined both for the upper processing unit 17 and for the lower processing unit 19. Labels can thereby, for example, be applied at any desired position at an upper package side or at a lower package side or the upper sides or lower sides of the packages 15 can be printed at generally any desired point if the processing units 17, 19 are not labelers, but rather printers.

It is understood that the longitudinal offset of the processing units 17, 19 in the adjustment direction S shown in FIG. 2 can also be zero, i.e. the processing units 17, 19 can be positioned relative to one another such that they are disposed exactly above one another. It is also possible in accordance with the invention that the positions of the two processing units 17, 19 are swapped over in the direction of transport T with respect to the arrangement in FIG. 2, i.e. the upper processing unit 17 in the direction of transport T is further to the front than the lower processing unit 19.

Figure 3:
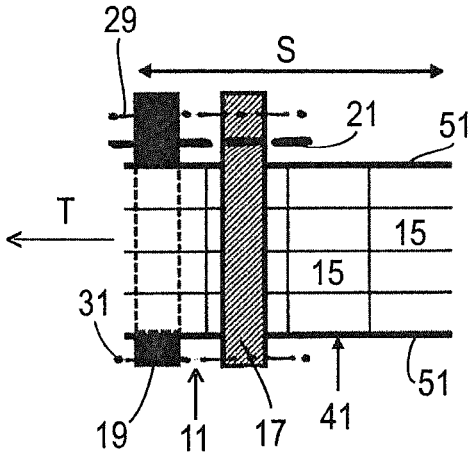

In the embodiment of FIG. 3, the two processing units 17, 19 are associated with different package rows 41. A longitudinal offset in the adjustment direction S of the two processing units 17, 19 by exactly one package row 41 is shown. The offset can also amount to more than one package row 41.

Different embodiments are generally possible with respect to the travelability of the two processing units 17, 19. Provision can thus be made that both processing units 17, 19 can only be traveled together and are in a forced coupling to this extent. It is also possible that, for example, only the lower processing unit 19 is travelable on the adjustment axle 21, but not the upper processing unit 17 that can instead be adjusted relative to the lower processing unit 19 on a further adjustment axle 21, not shown, that is arranged on the same machine side as the common adjustment axle 21. Since such a configuration enables a common adjustment by moving the lower processing unit 19 on the adjustment axle 21, the adjustment axle 21 is also a common adjustment axle for the two processing units 17, 19 in this configuration.

Figure 4:
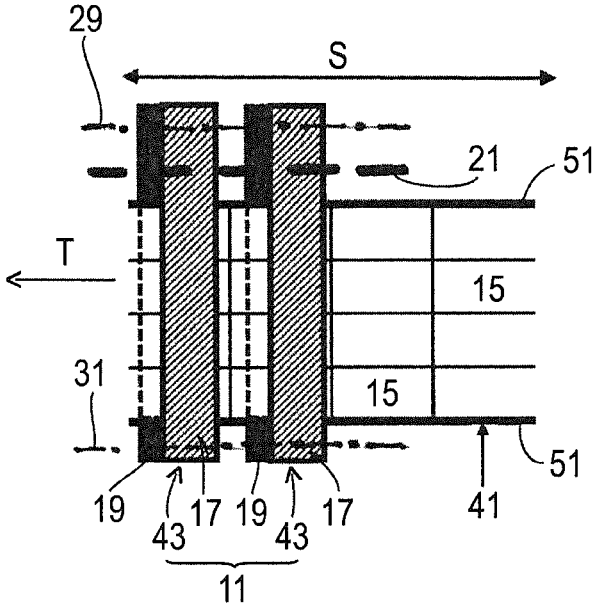

The embodiment of FIG. 4 is based on the configuration in accordance with FIG. 2, with here the processing apparatus 11 comprising two pairs of processing units 17, 19 and each pair 43 being associated with a package row 41, and with the two pairs 43 being offset with respect to each other by one package row 41 in the direction of transport T. It is understood that the offset can also amount to more than one package row 41.

As already mentioned in the introductory part, the processing performance can hereby be doubled or the possibility can be created of carrying out an additional processing of the upper sides and/or of the lower sides of the packages 15 that can optionally also only take place at times. So-called promotion labels or other additional labels or also prints can thus be applied to the packages 15, for example, for temporary promotions by means of the additional pair 43 of processing units 17, 19.

Figure 5:
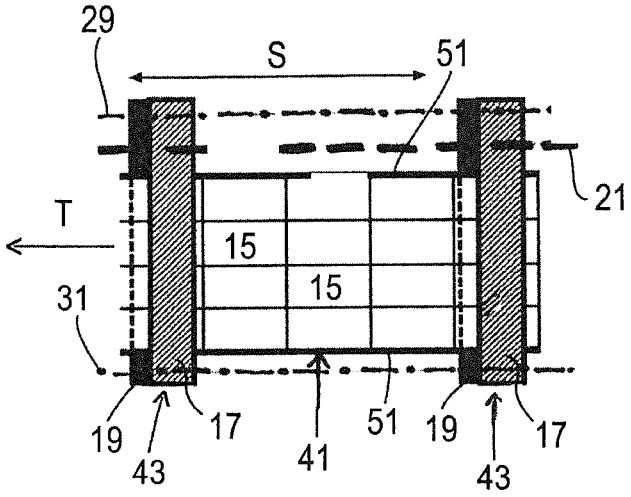

The embodiment shown in FIG. 5 is based on the concept of FIG. 4. Two pairs 43 of processing units 17, 19 are again provided here. The selective coupling and decoupling ability of the processing units 17, 19 by means of the coupling devices 27 mentioned above in connection with FIG. 1 can be used in this configuration, for example, to travel the right pair 43 of processing units 17, 19 in FIG. 5, for example, from a working position corresponding to the embodiment of FIG. 4 to the right against the direction of transport T into a non-working position in FIG. 5 to, for example, carry out servicing work or to change a label supply roll 45 (cf. FIG. 1). During this period of time, the processing of the packages 15 by means of the left pair of processing units 17, 19 in FIG. 5 is continued, which admittedly temporarily means a smaller processing performance, but is instead advantageously not associated with a temporary complete shutdown of the processing apparatus 11. Such a configuration consequently enables a so-called "no down time" function of the packaging machine that thus achieves a higher production performance overall.

The adjustment of the temporarily down processing units 17, 19 in the state decoupled from the adjustment axle 21 can take place, for example, manually or by a travel drive that comprises an adjustment axle (not shown) provided in addition to the common adjustment axle 21. An additional adjustment axle can be associated with both pairs 43 of processing units 17, 19. Alternatively, each pair 43 can have its own additional adjustment axle.

In all the embodiments described above and also in other possible embodiments in accordance with the invention, it is preferred in the event of a plurality of adjustment axles if all the adjustment axles are arranged at the same side of the packaging machine.

As already mentioned in the introduction, it is a substantial advantage of the invention that the operation of the processing unit can be completely transposed to only one side of the packaging machine. The effort for safety measures that may be necessary can furthermore be reduced, in particular safety measures due to the movability of the processing units and to the potential risk of crushing associated therewith. It is furthermore of advantage that the required work length of the packaging machine for the processing unit in accordance with the invention is comparatively small. In particular when a plurality of pairs of processing units are provided, a saving of the required machine length of 50% and more can be achieved in comparison with an increase in performance achieved in a conventional manner, without having to accept any compromises in function or performance.

Furthermore, the functions of "no down time" and "double speed plus no down time" typically required in practice can also be implemented without problem and indeed—as mentioned—with substantially fewer space requirements, in particular with respect to the work length of the packaging machine, with respect to the known solutions.

REFERENCE NUMERAL LIST

11 processing apparatus
13 packaging machine
15 package
17 upper processing unit
18 holder
19 lower processing unit

20 holder
21 adjustment axle
23 drive
25 control device
27 coupling device
29 guide
31 guide
33 transverse axle
35 additional unit
37 machine frame
41 package row
43 pair
45 supply roll
47 label web
49 lower rack
51 transport chain
T direction of transport
S adjustment direction

The invention claimed is:

1. A processing apparatus for packaging machines in which packages to be processed by the processing apparatus are transported along a direction of transport of the packaging machine, the processing apparatus comprising:

at least one upper processing unit for processing upper package sides and at least one lower processing unit for processing lower package sides; and a common adjustment axle for the processing units along which the processing units are adjustable manually or by means of a drive in an adjustment direction that extends in parallel with the direction of transport of the packaging machine, wherein the processing units are couplable to the adjustment axle and decouplable from the adjustment axle independently of one another, and wherein each processing unit comprises a coupling device that is manually actuatable or is controllable by means of a control device and that is configured to couple and decouple the processing unit and the adjustment axle to one another and from one another, and wherein the processing units can be adjusted in two different modes of operation, namely together and independently from one another along the adjustment axle during operation of the packaging machine.

2. The processing apparatus in accordance with claim 1, wherein the processing apparatus is for labeling and/or printing packages.

3. The processing apparatus in accordance with claim 1, wherein said means of a drive is provide by a common travel drive for the two processing units by which the processing units are travelable along the adjustment axle.

4. The processing apparatus in accordance with claim 1, wherein the processing units are adjustable along the common adjustment axle by said means of a drive, and wherein the means of a drive comprises an elongated drive member extending in the adjustment direction for the processing units.

5. The processing apparatus in accordance with claim 4, wherein the elongated drive member comprises one of a spindle, a toothed belt, and a gear rack.

6. The processing apparatus in accordance with claim 1, wherein, in addition to the adjustment axle, a guide extending in parallel with the adjustment direction is provided for the processing units.

7. The processing apparatus in accordance with claim 6, wherein the guide comprises a guide member or at least two guide members extending transversely to the adjustment direction at a spacing from one another.

8. The processing apparatus in accordance with claim 1, wherein, in addition to the adjustment axle for the processing units, at least one transverse axle extending transversely to the direction of transport is provided for at least one additional unit, with the transverse axle being movable along the adjustment axle in the adjustment direction manually or by means of a drive.

9. A packaging machine, having at least one processing apparatus in which packages to be processed by the processing apparatus are transported along a direction of transport of the packaging machine, the at least one processing apparatus comprising:

at least one upper processing unit for processing upper package sides and at least one lower processing unit for processing lower package sides; and a common adjustment axle for the processing units along which the processing units are adjustable manually or by means of a drive in an adjustment direction that extends in parallel with the direction of transport of the packaging machine, wherein a control device is provided that is configured to control a travel drive of the processing apparatus, and wherein the control device is configured to control coupling devices of the processing units in two different modes of operation, namely to adjust the processing units together and independently from one another in the adjustment direction during operation of the packaging machine.

10. The packaging machine in accordance with claim 9, wherein the processing apparatus is supported at a machine frame of the packaging machine.

11. The packaging machine in accordance with claim 9, wherein the adjustment axle of the processing apparatus is arranged at a side of a machine frame of the packaging machine.

12. The packaging machine in accordance with claim 11, wherein the adjustment axle of the processing apparatus is supported at the machine frame.

13. The packaging machine in accordance with claim 9, wherein the processing units are arranged in the same work section of the packaging machine, viewed in the direction of transport, said work section being associated with a package or with a package row disposed transversely to the direction of transport.

14. The packaging machine in accordance with claim 9, wherein the processing units are arranged in different work sections that are mutually offset in the direction of transport and that are each associated with a package or with a package row disposed transversely to the direction of transport.

15. The packaging machine in accordance with claim 9, wherein a plurality of pairs respectively comprising an upper processing unit and a lower processing unit are provided that are arranged in different work sections that are mutually offset in the direction of transport and that are each associated with a package or with a package row disposed transversely to the direction of transport.

16. The packaging machine in accordance with claim 9, wherein the processing units or pairs of processing units are movable from a working region into a non-working position independently of one another.

17. The packaging machine in accordance with claim 9, wherein the processing units are each movable in the adjustment direction within their work sections to set a respective desired processing offset between an upper processing position and a lower processing position.

* * * * *